United States Patent [19]

Weis

[11] 4,424,929

[45] Jan. 10, 1984

[54] CLIP MAGAZINE FEED FOR FASTENER DRIVING TOOLS

[75] Inventor: Charles W. Weis, Los Angeles, Calif.

[73] Assignee: Power-Wire Fastener Systems, Inc., El Monte, Calif.

[21] Appl. No.: 358,539

[22] Filed: Mar. 16, 1982

[51] Int. Cl.[3] ..... B25C 1/04; B25C 5/16

[52] U.S. Cl. ..... 227/32; 227/37; 227/120; 227/113; 227/115; 227/43; 227/116; 29/432

[58] Field of Search ..... 227/120, 113, 31, 32, 227/37, 114, 115, 116; 29/432, 432.1, 798, 816, 818

[56] References Cited

U.S. PATENT DOCUMENTS

| | | | |
|---|---|---|---|
| 2,886,815 | 5/1959 | Young . | |
| 3,612,378 | 10/1971 | Pabich . | |
| 3,633,810 | 1/1972 | Krakauer . | |
| 3,727,821 | 4/1973 | Pabich et al. . | |
| 4,389,012 | 4/1981 | Grikis et al. | 227/120 |

*Primary Examiner*—E. R. Kazenske
*Assistant Examiner*—James Wolfe
*Attorney, Agent, or Firm*—William H. Maxwell

[57] ABSTRACT

A clip magazine and feed for orienting a U-shaped clip and a staple fastener at the head of a fastener driving tool triggered after the separation of a single clip from a stacked supply thereof, the clip being automatically positioned for application to a work piece and mounted thereon through engagement of an actuator with the work piece and that retracts the stacked supply of clips from the single clip.

36 Claims, 9 Drawing Figures

FIG. 1.
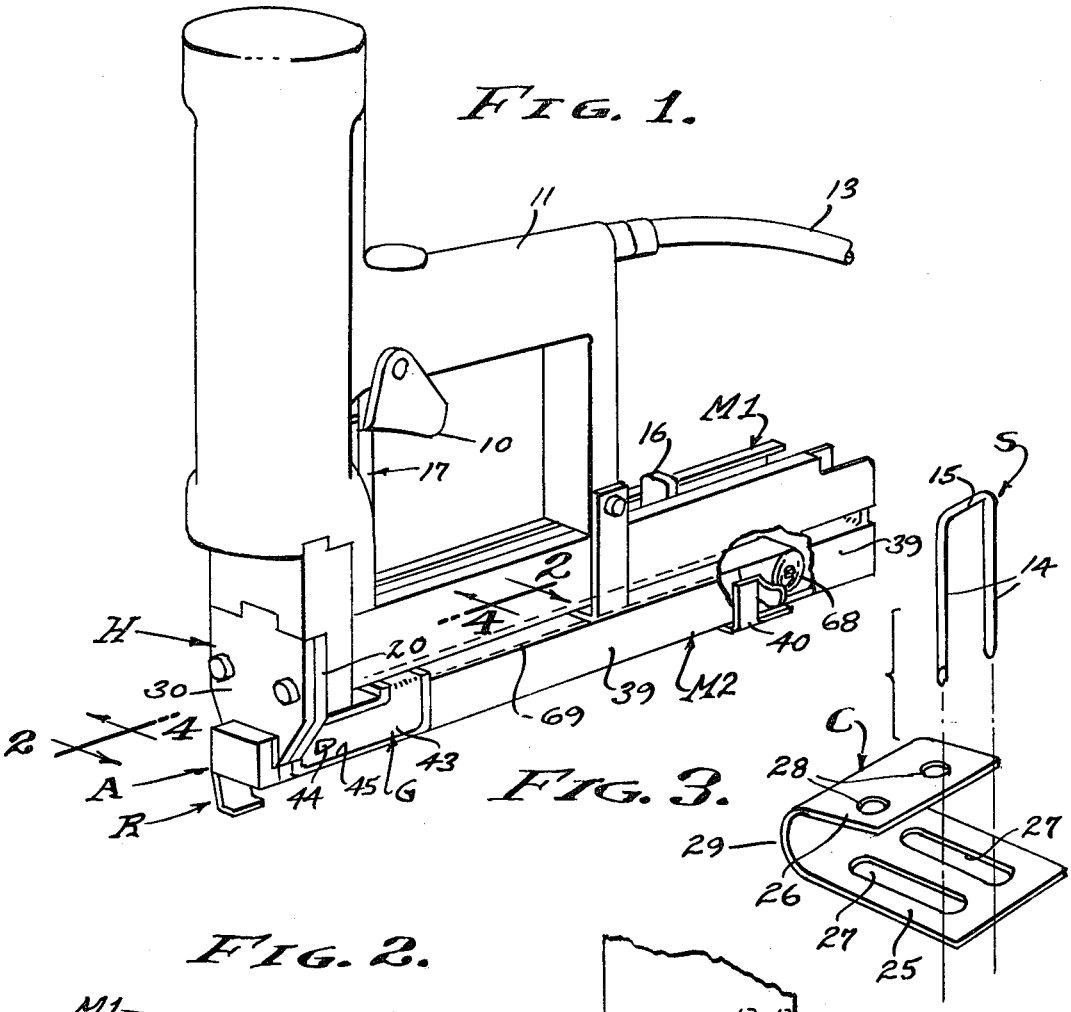
FIG. 3.
FIG. 2.
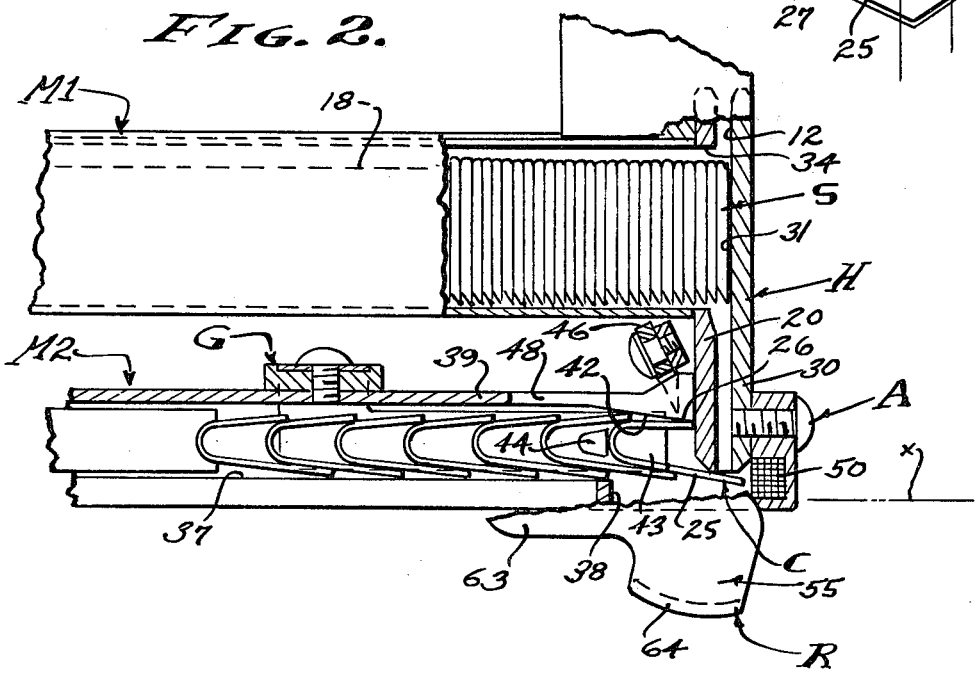

CLIP MAGAZINE FEED FOR FASTENER DRIVING TOOLS

BACKGROUND

This invention relates to the fastening of clips by means of staples and the like driven into a work piece. The particular clip which is of concern is a spring mounting clip of U-shape having diverging legs and one of which is longer than the other. These clips are used in the construction of furniture to hold spring coils and the like, and heretofore they have been installed individually by placing them manually followed by the application of a fastener driven by a hammer or by a pneumatic drive tool. Obviously, the manual hammer application and/or orientation of the pneumatic tool is time consuming. Accordingly, it is a general object of this invention to eliminate the handling and orientation of individual clips by automatically supplying them into oriented position with respect to a fastener tool during the fastener driving operation.

It is common practice to supply staples and clips from spring biased magazines carried by a single pneumatic fastener driving tool. However, the particular clip with which this invention is concerned has required individual handling, due to its U-shape and the dissimilar lengths of its two legs. Such clips are supplied as loose individual clips for manual application, and they are stacked in columnar formation for tool application and characterized by a nesting together and overlapped formation of sequential clips. This nested and overlapping of stacked clips has required their separation in feed mechanisms which have therefore been complicated and cumbersome and not altogether conducive to use in hand carried tools where light weight and compactness is to be desired. Heretofore, forward separation of the foremost clip from the stacked supply thereof has been unobvious and overlooked, and for example typical clip feeders have separated the foremost clip laterally from the magazine supply. Consequently, the clip magazines of the prior art have had interferring relationships with respect to the fastener magazines, and all of which has required separation and angular dispositions of one magazine to the other. It is an object of this invention to provide a compact and light weight clip magazine and feeder that is closely positioned and combined with a fastener magazine with which it cooperates to orient a single clip beneath a single staple for each succeeding installation of a clip fastened by a staple. With the present invention the sequential clip and fastener feed coordination is entirely automatic, as will be described.

The fastening of clips of the character herein referred to has required fastener driving tools of special head design and special fastener magazine design, in addition to the special design of a clip feeder and magazine therefor. It is an object of this invention to adapt a special clip feeder and magazine without requiring a special tool head design and without requiring a special fastener magazine design. In other words, the fastener driving tool head and fastener magazine remain unchanged, and all that is necessary is several anchor attachments for adapting the clip feeder and magazine as it is hereinafter described.

It is an object of this invention to adapt the aforesaid clip feeder and magazine close to the fastener magazine, adjacent thereto and in alignment below said fastener magazine. Therefore, the preferred clip magazine is bottom opening for travel of the stack pusher and manual access thereto. However, it is to be understood that top and side opening magazines are also feasible.

It is an object of this invention to separate the foremost clip from the columnar stacked supply thereof, preceeding the trigger actuation that operates the drive tool. With the present invention a lever means is depressed by engagement against the work piece, which retracts said columnar stack of clips from the said foremost clip to be secured. The said foremost clip is held positioned for receiving the fastener by gripper means and attractor means, as will be described.

It is an object to provide a clip magazine feed for fastener driving tools which is light weight and comprised of a minimum of simple and dependable parts that are accessible for maintenance while being protected as required in order to prevent damage thereto. Operation thereof is positive and trigger actuation of the drive tool is manual or timed, as desired, so that proper penetration of the clip by the fastener is ensured.

SUMMARY OF INVENTION

A power tool is provided with closely adjacent aligned magazines and one underlying the other. In practice, a clip magazine and feeder means is secured beneath the fastener magazine and driving head of a conventional fastener driving tool, it being a general object of this invention to secure one leg of a U-shaped clip onto a work piece by the application of a staple. Accordingly, the fastener magazine overlies the clip magazine from which a single clip is sequentially separated for its individual mounting onto the work piece by means of driving a staple therethrough. Although the clip mounting by means of staples is described herein, it is to be understood that securement by means of other types of fasteners is applicable, as for example by means of T-nails driven through a single opening or slot through the clip. A feature of this invention is the retraction of the supply stack of clips from the said separated or individual clip to be mounted. Another feature is the coordinated separation of a clip and/or separation of the supply stack with the driving action of the tool. In practice, a pneumatic staple driving tool is employed with its trigger actuated manually, or coordinated with the clip feed means when so desired, the latter being actuated by engagement with the work piece when offering up the foremost clip that is separated and retained within the forward end of the clip magazine and against the fastener driving head of the tool. This invention resides in the clip magazine and clip feeder means operating in timed relation with the operation of the fastener driving tool, in this instance a staple driving tool.

The foregoing and other various objects and features of this invention will be apparent and fully understood from the following detailed description of the typical preferred form and application thereof, throughout which description reference is made to the accompanying drawings.

FIG. 1 is a perspective view of a fastener driving tool with the clip magazine and feeder of the present invention adapted thereto.

FIG. 2 is an enlarged sectional view taken as indicated by line 2—2 on FIG. 1.

FIG. 3 is an enlarged perspective view of the clip and fastener relationship within the tool prior to driving the fastener through slots in the clip.

Figure 4:
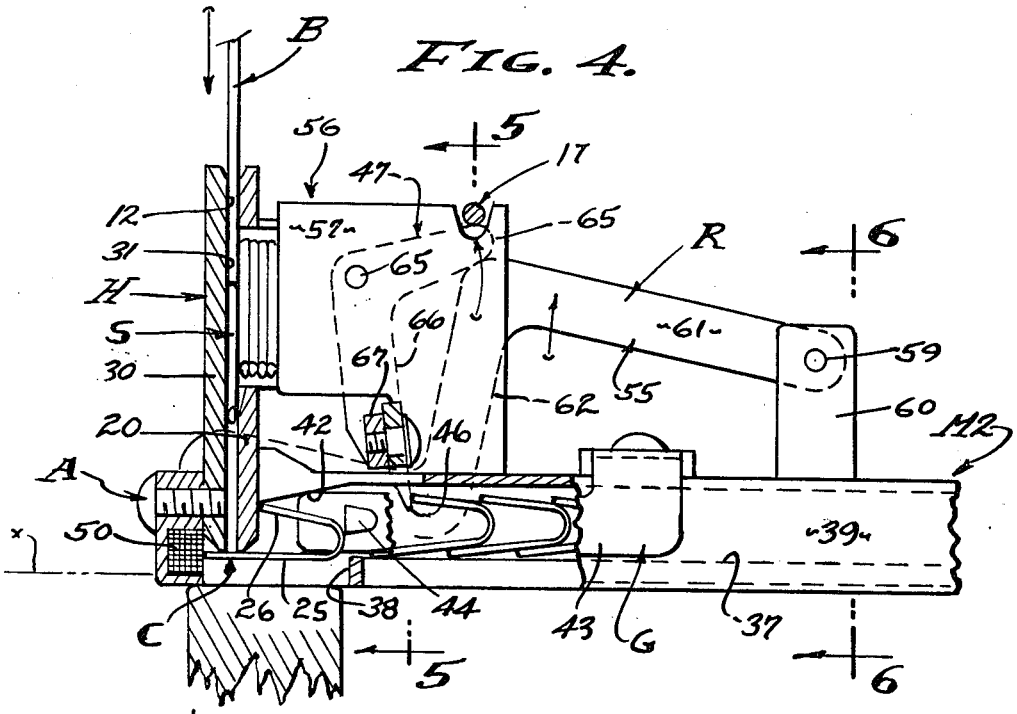
FIG. 4 is an enlarged sectional view taken as indicated by line 4—4 on FIG. 1, showing the initial separation of the foremost clip from the stack thereof.
Figure 5:
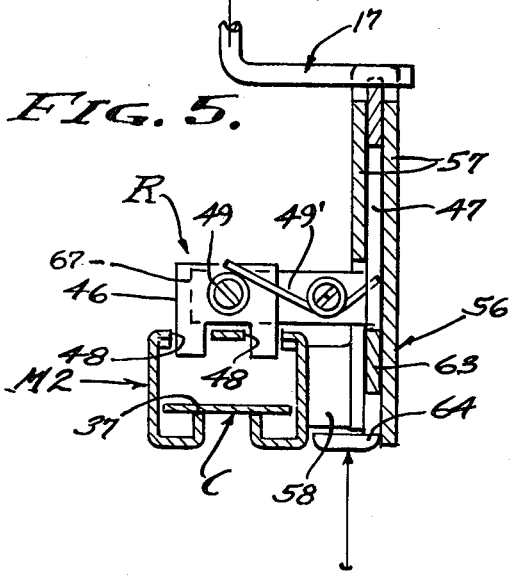
Figure 6:
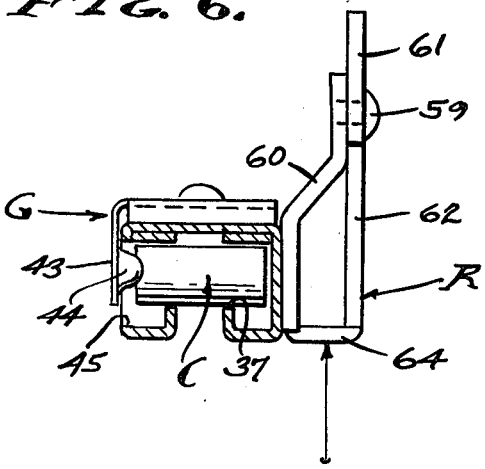

FIGS. 5 and 6 are sectional views taken as indicated by lines 5—5 and 6—6 on FIG. 4.

Figure 7:
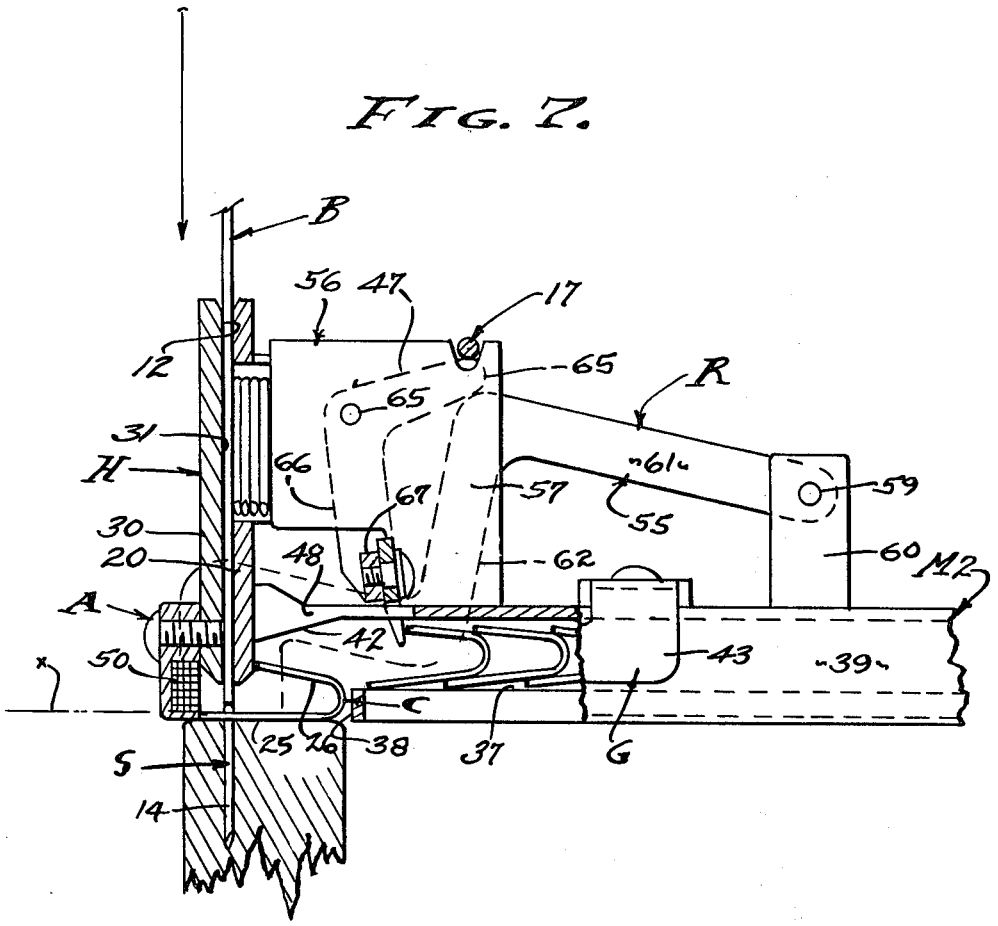

FIG. 7 is an enlarged sectional view similar to FIG. 4, showing the fastener driving of the fastener and installation of the clip into a work piece.

Figure 8:
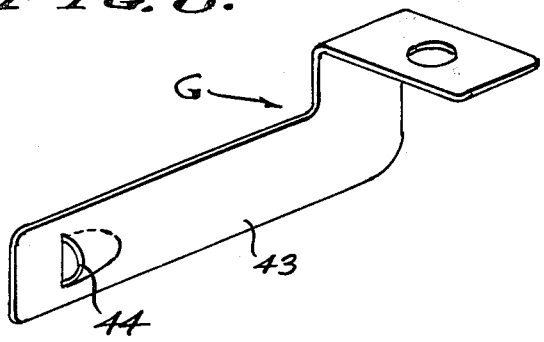

FIG. 8 is an enlarged perspective view of the spring which comprises the gripper means that retains the foremost clip.

Figure 9:
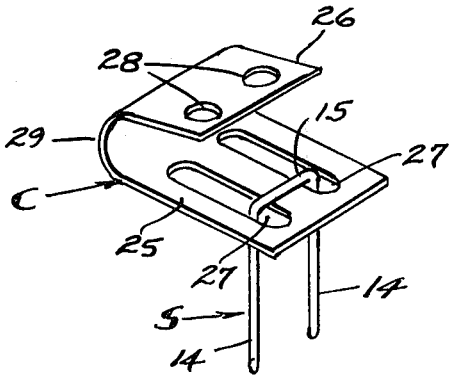

And, FIG. 9 is a view similar to FIG. 3 showing the clip and fastener relationship after driving the fastener through the clip and into the work piece.

PREFERRED EMBODIMENT

Referring now to the drawings, the power tool is shown as an air powered device comprised of cylinder and piston means P disposed on a vertical axis and operable through a trigger 10 on a handle 11 to reciprocate a driver blade B through a driveway 12. Compressed air for operation of the tool is supplied through a hose 13. The piston and driver blade operate to have an explosive driving stroke downwardly into engagement with the endmost fastener or staple S of a stick thereof and continuing so as to deliver the head or crown of the fastener at a driving plane x offset below the driving head of the tool. The work part or clip C to be penetrated and mounted presents its surface at said driving plane x where the legs or shanks 14 of the staple fastener S pass through openings in the clip and enter into the work piece to be secured and stabilized thereby. The head or crown 15 is driven into bearing engagement with the body of the clip C to engage it tightly to the work piece. As shown, the staple S has a pair of parallel and pointed shanks 14 of equal length. The stick supply of staples is formed by securing a multiplicity of identical staples in columnar formation as by means of a tape or destructable adhesive that yields to the shear force applied when the driver blade strikes an individual staple to sever it from the next remaining staple of the stick.

The clip C is peculiar to the present invention, being a U-shaped member of sheet metal having a lower mounting leg 25 greater in length than an upper leg 26. This clip is especially adapted to the fastening of springs to furniture frames and is characterized by a pair of notches or openings and preferably a pair of slots 27 in the lower leg aligned with a pair of holes 28 in the upper leg as shown. The upper leg stops short so as to expose the openings or slots in the lower leg for the passage of the staple shanks 14 therethrough, thereby to mount the clip in accordance with this invention, and prior to the subsequent securement of a spring (not shown). In practice, clip C of the type under consideration is fabricated of sheet steel with slightly divergent legs 25 and 26 joined by a semi-circular rear end 29 integral therewith, and all of which is designed to be constricted to embrace the spring when a second staple fastener is applied through said holes and slots and into the work piece. However, it is only the first driven staple fastener S with which this invention is concerned, that which secures the lower leg 25 through the exposed ends of the slots 27.

A head H and fastener magazine M1 supported thereby are carried by the cylinder and piston means P. The aforesaid driveway is incorporated in the head H for the delivery of individual staples sheared from the magazine M1 feeding thereto through an opening in a back plate 20, covered by a front plate 30. Characteristically, the magazine M1 extends normal to and rearward from the driveway plane, a substantial distance to carry a good supply of staples. A spring pressed follower 16 operates toward the head to force the stick supply forwardly into engagement with the front plate 30 which forms the front wall 31 of the driveway. The cross section of the driveway accommodates the cross section of the staple S with some clearance, and so that an individual staple S can be delivered through the driveway with each forward stroke of the driver blade B. The pneumatic cylinder and piston (not shown) is provided to drive and retract the driver blade for each operation of the tool. The operational features and details thereof are conventional with respect to constructing the tool, the trigger 10 being exposed for manual actuation, and there being a "bump" valve control 17 responsive to lever means engageable with the work piece as later described.

Referring to the magazine M1, the staples S in stick formation are slideably carried therein with points down and with the crowns 15 supported upon a rail 18 having a front face terminating in the plane of the back wall of the driveway, spaced from the front wall 31 the thickness of an individual staple (with some clearance). The rail is typically of rectangular cross section having a top and sides slideably engaging the crowns 15 and shanks 14 of the staples. As shown, the magazine M1 is a sheet metal channel fitted at its forward end to an opening 34 in the back plate 20 so as to feed the staples S into the driveway. The front plate 30 limits one staple at a time to enter said driveway with the staple crown exposed to the driver blade so as to be driven thereby. Note that the head H comprised of the plates 20 and 30 depends a substantial distance below the magazine M1 thereby extending the driveway opening to intercept clips C delivered forwardly by the magazine M2 next to be described.

Referring now to the magazine M2, the clips C in columnar stacked formation are slideably carried therein with their legs 25 and 26 projecting forwardly and with their ends 29 embraced one within the legs of the next succeeding clip. In practice, the clips C are entered into the magazine M2 in said columnar stacked loose formation from a feed tube type packaging from which they are supplied. The lower mounting legs 25 are supported upon rails 37 having a front face 38 spaced back from the back plate 20, as shown, to provide a clip delivery opening. The rail 37 is comprised of a pair of upwardly turned portions of the magazine housing 39, the housing having a rectangular cross sectional configuration to freely pass and guide the columnar stack of clips C. In its preferred form, the magazine housing 39 is of downwardly open C-shape with imperforate top and side walls, and with a slotted bottom wall defined by spaced upwardly turned flanges forming said rail 37. The rearmost end of the housing 39 is open for the reception of the clips C, and a manually retractable spring pressed follower 40 operates toward the open forward end of the housing 39 for force the columnar stack of clips C forwardly and into engagement with rear wall of the back plate 20. A feature of this invention is that it is the upper leg 26 of the clip which has stopped engagement with the rear wall of the plate 20, while the lower leg 25 underlies and passes beneath the back plate 20 and front plate 30 so as to expose the forward portions of the slots 27 to the driveway opening defined by and between said plates. The embracement of the next succeeding clip C with the foremost clip C holds the latter in position as shown clearly in FIG. 2 of the drawings.

The magazines M1 and M2 are attached to the head H of the tool, and they are stabilized by a bracket so as to be parallel to and extending from the cylinder and piston means P of the tool, and as shown in the drawings the magazine M2 is closely positioned beneath and in parallel alignment with magazine M1. In accordance with this invention the columnar stack of clips C is normal and at a right angle to the head H and driveway therein, and a feature is the foremost clip separation as it is shown in FIG. 2 wherein the upper leg 26 of clip C is depressed by a declined cam 42 which causes the foremost clip to rock upon the forward edge of the lower leg of the next succeeding clip. Note that the front edge of the lower leg 25 of said next succeeding clip establishes a fulcrum, whereby any adhesion of one clip to the other is broken so as to separate the two clips that were tightly nested. Accordingly, the foremost clips C in said columnar stack formation yields to the above described cam applying a "breaking" action when the spring pressed follower 40 forces the columnar stack of clips into stopped engagement with the rear of the back plate 20. A feature is that the upper leg 26 of the foremost clip C in this initial separation is positioned normal to and at a right angle to the rear plane of the back plate.

In accordance with this invention, gripper means G is provided to retain the foremost clip C in the aforesaid stopped position against the rear of the back plate 20. Gripper means G is shown herein as a leaf spring 43 having a forwardly faced ratchet tooth 44 entering the magazine housing 39 through a side window 45 therein, and positioned so as to engage the rear of the end 29 of said foremost clip when it is in said stopped position. Separation is now initiated, separation of the columnar stack of clips from the foremost clip, with the overlapped relation with the foremost clip and next succeeding clip remaining.

In accordance with this invention retraction means R is provided to withdraw the columnar stack of clips C from the stopped and retained foremost clip C. The retraction means R is shown as a pawl 46 that shifts or moves between advanced and retracted positions, to be released from and to engage with the columnar stack of clips C. In carrying out this invention, the pawl 46 is a bifurcated member that straddles the above described cam 42, and it swings on a bellcrank lever 47, so as to withdraw from the foremost clip C as it is depressed by said cam 42, and so as to enter the magazine housing 39 through slots 48 to engage and retract the columnar stack of clips as shown clearly in FIG. 4. In order to align with manufactured variations in clip configuration, to ensure release from the clip engaged thereby, and to prevent binding, the pawl 46 is loosely captured onto the lever 47 by means of a shouldered screw 49, so as to float within restricted limits of position and depressed into a normal position, as shown, by a spring 49' (see FIG. 5).

In accordance with this invention, attractor means A is provided to hold the lower leg 25 of the foremost clip C aligned with the driveway in head H, for passing of the staple fastener shanks 14 through the slots 27. Upon the aforementioned initial release and subsequent retraction of the columnar stack of clips C, the foremost clip C is free to be drawn into said aligned position and being of steel it is attracted to the head H by the attractor means A in the form of a permanent magnet 50 secured to the front plate 30 and with a flat face to engage and locate the front edge of leg 25. From FIG. 4 of the drawings it will be seen that the front edge of leg 26 acts as a fulcrum about which the face of foremost clip C rotates so that the lower leg 25 stops flat against the nose of the head H and in a plane normal to the driveway. Thus, the divergent leg 26 is no longer normal to the back plate 20. This positions the slots 27 in alignment with the staple shanks 14 to be driven therethrough.

Operation of the retraction means R is by actuator means K comprised of a work engageable lever 55 that swings the bellcrank lever 47 as the magazine M2 is brought into coplanar relationship with the driving plane x onto which the fastener S is to be driven through the pair of slots 27 in the clip C. Levers 47 and 55 are carried at the opposite side of the magazine M2 from the window 45 therein, opposite the side where the gripper means G operates. As shown, there is a guide bracket 56 disposed in a vertical plane at the side of magazine M2 to guide the lever 55 and to provide a fulcrum for lever 47. Guiding of lever 55 is by means of spaced and parallel plates 57 between which the levers 47 and 55 operate, and all of which is fixed to the side of magazine M2 at 58.

The lever 55 is a second class lever having an elevated fulcrum comprised of a pivot 59 on a vertically disposed bracket 60 secured to said opposite side of magazine M2. In practice, the lever 55 has an upper portion 61 that extends horizontally when the mechanism is conditioned as shown in FIG. 2, to be embraced within the confines of the bracket plates 57. The lever 55 is dog-legged with a depending portion 62 that extends to a lower portion 63 having a foot 64 engageable with the work piece. Portions 61 and 63 extend forwardly, so that the foot 64 is to the side of head H and normally disposed substantially below the drive plane x. Foot 64 is subject to being pressed upwardly relative to the tool when said tool is lowered into position preparatory to driving a staple S.

The lever 47 is a first class lever having an elevated fulcrum comprised of a pivot 65 on the vertically disposed bracket 60, forward of the upper portion 61 of lever 55 and intermediate the retracted and advanced positions of pawl 46 carried by said lever 47. The said retracted position of pawl 46 is shown in FIG. 2, and the advanced position thereof is shown in FIGS. 4 and 7. The advanced position effects the retraction of the stack of clips C following the foremost clip C. The lever 47 is L-shaped with an upper portion 65 engageably overlying the front end of portion 61 of lever 55 to be revolved thereby, and it has a depending portion 66 with a transverse bar 67 (see FIG. 5) that carries the mounting screw 49 and depressing spring 49' for the pawl 46, all as hereinabove described. When the lever 55 is revolved by raising the foot 64, the lever 47 is also revolved to advance the position of the pawl 46 and thereby retract the stack of clips C remaining behind the foremost clip C. In a "bump" operated tool, there is the valve control 17 depending from the valve at trigger 10 and engaged by the lever portion 65 to actuate when the foot 64 is depressed as shown in FIGS. 4 and 7. Accordingly, the foremost clip C is now free to be fastened.

A feature of this invention is that return of the levers 55 and 47 to a retracted position as shown in FIG. 2 is inherent with operation of the magazine M2 and its follower 40. As shown in FIG. 1 of the drawings, the follower 40 carries a spirally coiled spring 68 extended at 69 to the head H where it is anchored, and which biases the follower 40 to yieldingly urge the columnar stack of clips forwardly. Accordingly, the follower 40 biased by spring 68 normally urges the complete stack of nested clips C into firm engagement with the rear face of back plate 20. The spring 68 also permits the stack of clips to yield rearwardly so as to be positioned as shown in FIGS. 4 and 7. Alternately, the levers 55 and/or 47 can be revolved or shifted between the aforesaid positions by any other suitable means such as, for example, a cylinder and piston means (not shown) timed with operation of the fastener driving tool.

From the foregoing it will be seen that the clip magazine M2 cooperatively combined with the gripper means G, the attractor means A, the retractor means R, and the actuator means K, is effective in the separation and fastened mounting of a single clip C, upon triggering of the fastener driving tool adapted thereto as hereinabove described. Functionally, the clips are first moved to the forward end of the magazine M2 by means of a spring loaded pusher 16. As the magazine M2 is firmly placed against the work piece, the lever 55 lifts so as to act upon the lever 47. The finger-like pawl 46 moves the stack of clips back, leaving the first and foremost clip C separated from said stack of clips, and clip C held securely in the advance position by the gripper means G and subsequently by the magnet of the attractor means A. The tool is now triggered to drive the staple S through the slots 27 in the clip C and so as to move the clip downward and fasten it to the work piece. The tool trigger is then released and the tool and magazines M1 and M2 raised from the work piece for subsequent clip installations, thereby allowing the actuator means K to permit the pawl 46 to return to the retracted position in order to pick up the next succeeding clip C which becomes the foremost clip next to be fastened.

Having described only a typical preferred form and application of my invention, I do not wish to be limited or restricted to the specific details herein set forth, but wish to reserve to myself any modifications or variations that may appear to those skilled in the art as set forth within the limits of the following claims.

I claim:

1. A clip feed for a fastener driving tool with a driveway through a head having a rear face projecting to a driving plane offset from a first magazine means and through which driveway a driver blade reciprocates to sever a fastener from a supply thereof advanced by said first magazine means and to deliver the same through said driving plane and into a work piece, a plurality of clips each of which being of U-shape with a lower forwardly extending mounting leg of greater length than an overlying upper leg for vertical exposure of an opening through the lower mounting leg, and including; a second magazine means underlying the first magazine means and open to the rear face of the head to sequentially deliver a nested stack of said clips and the upper leg of the foremost clip thereof into stopped engagement with said rear face of the head and with the lower mounting leg underlying the head and the opening therethrough substantially aligned with the driveway through the head, gripper means preventing retraction of said foremost clip from said stopped engagement with the head, a normally advanced retraction means withdrawing the stack of clips from the foremost clip when positioned relative to the work piece for application of the clip thereto, and means operating the driver blade to sever and deliver a fastener through the opening in the lower mounting leg of the foremost clip and fastening the same onto the work piece.

2. The clip feed for a fastener driving tool as set forth in claim 1, wherein a declining cam in the second magazine means engages and depresses the upper leg of the foremost clip to rotate said clip relative to the nested stack of succeeding clips to initially break away therefrom.

3. The clip feed for a fastener driving tool as set forth in claim 1, wherein the upper and lower legs of the U-shaped clips are divergent, and wherein a declining cam in the second magazine means engages and depresses the upper leg of the foremost clip to rotate said clip relative to the nested stack of succeeding clips and initially breaking the nested engagement of the foremost clip.

4. The clip feed for a fastener driving tool as set forth in claim 1, wherein the gripper means comprises a forwardly faced tooth member engageable with the foremost clip when in said stopped engagement with the rear face of the head of the fastener driving tool.

5. The clip feed for a fastener driving tool as set forth in claim 1, wherein the gripper means comprises a spring member with a forwardly faced tooth yieldingly biased thereby into engagement with the foremost clip in said stopped engagement with the rear face of the head of the fastener driving tool.

6. The clip feed for a fastener driving tool as set forth in claim 1, wherein the second magazine means comprises a housing with rails supporting the nested stack of clips and with a side window, and wherein the gripper means comprises a leaf spring operable through the side window and with a forwardly faced tooth yieldingly entering the housing and biased into engagement with the rear end foremost clip in said stopped engagement with the rear face of the head of the fastener driving tool.

7. The clip feed for a fastener driving tool as set forth in claim 1, wherein the normally advanced retracting means comprises a pawl engageable with the upper leg of the next succeeding clip nested with the foremost clip and means shifting the pawl between advanced and retracted positions.

8. The clip feed for a fastener driving tool as set forth in claim 1, wherein the normally advanced retracting means comprises a pawl engageable with the upper leg of the next succeeding clip nested with the foremost clip and shiftable between advanced and retracted positions in response to the positioning of the said driving plane relative to the work piece.

9. The clip feed for a fastener driving tool as set forth in claim 1, wherein the normally advanced retraction means comprises a work piece engageable lever lifted in response to the positioning of the said driving plane relative to the work piece, and a pawl engaged with and shifted by the lifted lever and engageable with the upper leg of the next succeeding clip nested with the foremost clip to retract the nested stack of clips from the foremost clip.

10. The clip feed for a fastener driving tool as set forth in claim 1, wherein the normally advanced retraction means comprises a work piece engageable lever lifted in response to the positioning of the said driving plane relative to the work piece, and a lever engaged with the first mentioned lever and carrying a pawl and shifted by the first mentioned lever when lifted and engageable with the upper leg of the next succeeding clip nested with the foremost clip to retract the nested stack of clips from the foremost clip.

11. The clip feed for a fastener driving tool as set forth in claim 1, wherein the normally advanced retraction means comprises a second degree lever engageable with the work piece to be lifted in response to the positioning of the said driving plane relative to the work piece, and a first degree lever engaged by a portion of the second degree lever and carrying a pawl shifted when the second degree lever is lifted and engageable with the upper leg of the next succeeding clip nested with the foremost clip to retract the nested stack of clips from the foremost clip.

12. The clip feed for a fastener driving tool as set forth in claim 1, wherein the normally advanced retraction means comprises a second degree lever engageable with the work piece to be lifted in response to the positioning of the said driving plane relative to the work piece, and a first degree bellcrank lever with a first leg engaged by a portion of the second degree lever and with a second leg carrying a pawl shifted when the second degree lever is lifted and engageable with the upper leg of the next succeeding clip nested with the foremost clip to retract the nested stack of clips from the foremost clip.

13. The clip feed for a fastener driving tool as set forth in any one of claims 8 through 12, wherein the normally advanced retraction means is biased by a spring to retract from the nested stack of clips for advancing the next succeeding clip into a foremost position.

14. The clip feed for a fastener driving tool as set forth in any one of claims 8 through 12, wherein the normally advanced retraction means is biased by a spring biased follower of the second magazine means to retract from the nested stack of clips for advancing the next succeeding clip into a foremost position.

15. The clip feed for a fastener driving tool as set forth in any one of claims 8 through 12, wherein means holds the lower mounting leg of the foremost clip to an underlying position relative to the head of the fastener driving tool.

16. The clip feed for a fastener driving tool as set forth in any one of claims 8 through 12, wherein attractor means comprising a magnet with a stop face forward of the driveway through the head stops and holds the lower mounting leg of the foremost clip to an underlying position relative to the head of the fastener driving tool.

17. The clip feed for a fastener driving tool as set forth in any one of claims 8 through 12, wherein the fastener driving tool is power operated with manually operable trigger means actuating cylinder and piston means to reciprocate the driver blade.

18. The clip feed for a fastener driving tool as set forth in any one of claims 8 through 12, wherein the fastener driving tool is power operated with a manually actuable trigger means actuating cylinder and piston means upon contact with the work piece to reciprocate the driver blade.

19. A clip feed for a staple driving tool with a driveway through a head having a rear face projecting to a driving plane offset from a first magazine means and through which driveway a driver blade reciprocates to sever a staple from a supply thereof advanced by said first magazine means and to deliver the same through said driving plane and into a work piece, the staple being of inverted U-shape with a pair of like spaced and parallel shanks adapted to penetrate into the work piece, a plurality of clips each of which being of horizontal U-shape with a lower forwardly extending mounting leg of greater length than an overlying upper leg for vertical exposure of a pair of like and parallel openings spaced to pass the pair of spaced staple shanks opening through the lower mounting leg, and including; a second magazine means underlying the first magazine means and open to the rear face of the head to sequentially deliver a nested stack of said clips and the upper leg of the foremost clip thereof into stopped engagement with said rear face of the head and with the lower mounting leg underlying the head and the opening therethrough substantially aligned with the driveway through the head, gripper means preventing retraction of said foremost clip from said stopped engagement with the head, a normally advanced retraction means withdrawing the stack of clips from the foremost clip when positioned relative to the work piece for application of the clip thereto, and means operating the driver blade to sever and deliver a staple and driving the pair of shanks thereof through the pair of openings through the lower mounting leg of the foremost clip and fastening the same onto the work piece.

20. The clip feed for a staple driving tool as set forth in claim 19, wherein a declining cam in the second magazine means engages and depresses the upper leg of the foremost clip to rotate said clip relative to the nested stack of succeeding clips to initially break away therefrom.

21. The clip feed for a staple driving tool as set forth in claim 19, wherein the upper and lower legs of the U-shaped clips are divergent, and wherein a declining cam in the second magazine means engages and depresses the upper leg of the foremost clip to rotate said clip relative to the nested stack of succeeding clips and initially breaking the nested engagement of the foremost clip.

22. The clip feed for a staple driving tool as set forth in claim 19, wherein the gripper means comprises a forwardly faced tooth member engageable with the foremost clip when in said stopped engagement with the rear face of the head of the staple driving tool.

23. The clip feed for a staple driving tool as set forth in claim 19, wherein the gripper means comprises a spring member with a forwardly faced tooth yieldingly biased thereby into engagement with the foremost clip in said stopped engagement with the rear face of the head of the staple driving tool.

24. The clip feed for a staple driving tool as set forth in claim 19, wherein the second magazine means comprises a housing with rails supporting the nested stack of clips and with a side window, and wherein the gripper means comprises a leaf spring operable through the side window and with a forwardly faced tooth yieldingly entering the housing and biased into engagement with the rear end foremost clip in said stopped engagement with the rear face of the head of the staple driving tool.

25. The clip feed for a staple driving tool as set forth in claim 19, wherein the normally advanced retracting means comprises a pawl engageable with the upper leg of the next succeeding clip nested with the foremost clip and means shifting the pawl between advanced and retracted positions.

26. The clip feed for a staple driving tool as set forth in claim 19, wherein the normally advanced retracting means comprises a pawl engageable with the upper leg of the next succeeding clip nested with the foremost clip and shiftable between advanced and retracted positions in response to the positioning of the said driving plane relative to the work piece.

27. The clip feed for a staple driving tool as set forth in claim 19, wherein the normally advanced retraction means comprises a work piece engageable lever lifted in response to the positioning of the said driving plane relative to the work piece, and a pawl engaged with and shifted by the lifted lever and engageable with the upper leg of the next succeeding clip nested with the foremost clip to retract the nested stack of clips from the foremost clip.

28. The clip feed for a staple driving tool as set forth in claim 19, wherein the normally advanced retraction means comprises a work piece engageable lever lifted in response to the positioning of the said driving plane relative to the work piece, and a lever engaged with the first mentioned lever and carrying a pawl and shifted by the first mentioned lever when lifted and engageable with the upper leg of the next succeeding clip nested with the foremost clip to retract the nested stack of clips from the foremost clip.

29. The clip feed for a staple driving tool as set forth in claim 19, wherein the normally advanced retraction means comprises a second degree lever engageable with the work piece to be lifted in response to the positioning of the said driving plane relative to the work piece, and a first degree lever engaged by a portion of the second degree lever and carrying a pawl shifted when the second degree lever is lifted and engageable with the upper leg of the next succeeding clip nested with the foremost clip to retract the nested stack of clips from the foremost clip.

30. The clip feed for a staple driving tool as set forth in claim 19, wherein the normally advanced retraction means comprises a second degree lever engageable with the work piece to be lifted in response to the positioning of the said driving plane relative to the work piece, and a first degree bellcrank lever with a first leg engaged by a portion of the second degree lever and with a second leg carrying a pawl shifted when the second degree lever is lifted and engageable with the upper leg of the next succeeding clip nested with the foremost clip to retract the nested stack of clips from the foremost clip.

31. The clip feed for a staple driving tool as set forth in any one of claims 26 through 30, wherein the normally advanced retraction means is biased by a spring biased follower of the second magazine means to retract from the nested stack of clips for advancing the next succeeding clip into a foremost position.

32. The clip feed for a staple driving tool as set forth in any one of claims 26 through 30, wherein the normally advanced retraction means is biased by a spring to retract from the nested stack of clips for advancing the next succeeding clip into a foremost position.

33. The clip feed for a staple driving tool as set forth in any one of claims 26 through 30, wherein means holds the lower mounting leg of the foremost clip to an underlying position relative to the head of the staple driving tool.

34. The clip feed for a staple driving tool as set forth in any one of claims 26 through 30, wherein attractor means comprising a magnet with a stop face forward of the driveway through the head stops and holds the lower mounting leg of the foremost clip to an underlying position relative to the head of the staple driving tool.

35. The clip feed for a staple driving tool as set forth in any one of claims 26 through 30, wherein the staple driving tool is power operated with manually operable trigger means actuating cylinder and piston means to reciprocate the driver blade.

36. The clip feed for a staple driving tool as set forth in any one of claims 26 through 30, wherein the staple driving tool is power operated with a manually actuable trigger means actuating cylinder and piston means upon contact with the work piece to reciprocate the driver blade.

* * * * *